US005624053A

United States Patent [19]

Freek et al.

[11] Patent Number: 5,624,053

[45] Date of Patent: Apr. 29, 1997

[54] DRINK-THRU CUP LID

[75] Inventors: Mike Freek; Raya Berkovich, both of Toronto, Canada

[73] Assignee: James River Corporation of Virginia, Richmond, Va.

[21] Appl. No.: 467,718

[22] Filed: Jun. 6, 1995

[51] Int. Cl.[6] ..... A47G 19/22

[52] U.S. Cl. ..... 220/713; 220/380

[58] Field of Search ..... 215/387; 220/711, 220/713, 716, 717, 718, 380

[56] References Cited

U.S. PATENT DOCUMENTS

| | | | |
|---|---|---|---|
| Re. 29,898 | 2/1979 | Wheeler . | |
| 2,534,614 | 12/1950 | Michael . | |
| 3,868,043 | 2/1975 | Freemyer . | |
| 4,014,459 | 3/1977 | Robinson . | |
| 4,090,660 | 5/1978 | Schram et al. . | |
| 4,187,954 | 2/1980 | Striggow . | |
| 4,243,156 | 1/1981 | Lobbestael . | |
| 4,303,170 | 12/1981 | Panicci . | |
| 4,345,695 | 8/1982 | Galloway et al. . | |
| 4,350,260 | 9/1982 | Prueher . | |
| 4,441,624 | 4/1984 | Sokolowski . | |
| 4,589,569 | 5/1986 | Clements . | |
| 4,767,019 | 8/1988 | Horner . | |
| 4,795,052 | 1/1989 | Hayes, Jr. . | |
| 4,987,024 | 1/1991 | Newman et al. | 220/713 |
| 5,183,172 | 2/1993 | Boller . | |
| 5,253,781 | 10/1993 | Van Melle et al. . | |
| 5,398,843 | 3/1995 | Warden et al. | 220/711 |

*Primary Examiner*—Stephen Cronin

*Attorney, Agent, or Firm*—Sixbey, Friedman, Leedom & Ferguson, P.C.; Charles M. Leedom, Jr.; Donald R. Studebaker

[57] ABSTRACT

A disposable drink-thru lid for a drinking cup including an annular mounting portion for sealingly engaging the drinking cup, an annular trough provided about an inner periphery of the annular mounting portion as well as an annular side wall extending upwardly from the trough to a top land in the form of an annular ridge adjacent an uppermost extremity of the annular side wall is disclosed. The top portion of the lid includes a crown region having a periphery adjacent the annular ridge wherein the annular ridge is asymmetrical having a widened region accommodating a drink-thru opening and a narrowed region diametrically opposed to the widened region of the annular ridge. Further, the periphery of the crown region lies in a first substantially horizonal plane while the annular ridge includes a substantially planar surface with this surface lying in a plane above the planed defined by the periphery of the crown region thereby forming a retaining wall for retaining a container placed thereon.

15 Claims, 3 Drawing Sheets

DRINK-THRU CUP LID

TECHNICAL FIELD OF THE INVENTION

The present invention relates generally to lids for beverage containers and more specifically to lids which permit drinking of the contents of the container while the lid remains in place on such container.

BACKGROUND OF THE INVENTION

It is well-known to provide covers for drinking containers to prevent the spillage of the contents of the container. Many prior art covers incorporate an opening in the top of the cover in order to allow drinking of the contents either in the normal drinking fashion or by the insertion of a straw. Some covers utilize a releasable drinking flap in order to prevent the sloshing of the contents out of the containers. Other covers have an opening which is sealed by a depressible tab such that when the tab is depressed, the opening is unsealed for either drinking the contents of the container or for the pouring of the contents from the container.

As discussed hereinabove, lids have been proposed having preformed openings therein which permit the contents of the container to be drank through the opening or the contents to be poured from the container without removing the lid. However, in many proposed designs, the opening is positioned in a manner such that when the container is full, the contents may be readily spilled therefrom if the container is jarred even the slightest. In an effort to overcome the spillage problem, consumption of the contents of the container by the consumer is difficult due to the positioning of the opening. In an effort to overcome the aforementioned shortcomings, the lid design set forth in U.S. Pat. No. 4,441,624 issued to Sokolowski discloses a drinking cover for a beverage container including a circular wall and annular side wall which is sealingly received on a respective container. In this instance, the top wall is tapered downwardly from front to back and includes an opening therein which is covered by a sealing flap which is positioned on the inside of the top wall of the cover. When pressure from the user's mouth is placed about the opening in the top wall, the sealing flap is displaced from the opening permitting the contents of the container to be poured therefrom. However, manufacturer of such a lid requiring a two-piece construction is both complicated and expensive and results in a lid design which is cumbersome and difficult to use by the consumer.

In an effort to overcome the aforementioned shortcomings, the lid design disclosed in U.S. Pat. No. 4,589,569 issued to Clements includes a lid construction having an annular mounting portion for engaging the lip of a respective cup as well as an annular side wall similar to that discussed hereinabove. Additionally, a recess for receiving the lip of the consumer is provided in a top surface of the lid to allow the consumer to grip the portion of the lid adjacent the drink-thru opening formed in the top wall. While the recess makes the contents of the container more accessible by the consumer, the surface for supporting a second cup containing a beverage is significantly interrupted which may permit the second container to easily topple over should a portion of the bottom of the container extend into the recess. Moreover, with a centrally located top surface, the size of the drinking opening is necessarily restricted, thus constricting the flow of fluid therethrough.

Clearly, there is a need for a disposable drink-thru lid which prevents spillage of the contents of the container incorporating the lid while also providing a continuous top surface for supporting a second container thereon. Moreover, there is a need for a drink-thru disposable lid which provides a drink-thru opening which minimizes the restriction of the fluid flow therethrough while permitting the consumer to comfortably drink the contents of the container with the lid in place.

SUMMARY OF THE INVENTION

A primary object of the present invention is to provide a disposable drink-thru lid design which overcomes the aforementioned shortcomings associated with prior art designs.

A further object of the present invention is to provide a disposable drink-thru lid wherein a second beverage container can be placed on and reliably supported by the disposable lid.

Yet another object of the present invention is to provide a disposable drink-thru lid wherein access to the drink-thru opening of the lid is readily achievable by the consumer while providing a significant annular trough for receiving overflow through the drink-thru opening while also providing sufficient surface area in the top wall of the lid to support a subsequent container placed thereon.

A still further object of the present invention is to provide a disposable drink-thru lid design wherein the top wall of the lid is formed having a raised central portion for directing any overflow from the drink-thru opening to the outer periphery of the top wall.

Yet another object of the present invention is to provide a disposable drink-thru lid configuration wherein the top wall includes a detent in the region of the user's nose when the contents of the container are being consumed through the drink-thru opening which permits greater access to the drink-thru opening by the consumer.

These, as well as additional objects of the present invention, are achieved by providing a disposable drink-thru lid for a drinking cup including an annular mounting portion for sealingly engaging the drinking cup, an annular trough provided about an inner periphery of the annular mounting portion as well as an annular side wall extending upwardly from the trough to a top land in the form of an annular ridge adjacent an uppermost extremity of the annular side wall. The top portion of the lid includes a crown region having a periphery adjacent the annular ridge wherein the annular ridge is asymmetrical having a widened region accommodating a drink-thru opening and a narrowed region diametrically opposed to the widened region of the annular ridge. Further, the periphery of the crown region lies in a first substantially horizonal plane while the annular ridge includes a substantially planar surface with this surface lying in a plane above the planed defined by the periphery of the crown region thereby forming a retaining wall for retaining a container placed thereon.

These, as well as additional objects of the present invention will become apparent from the following derailed description when read in light of the several figures.

DETAILED DESCRIPTION OF THE PREFERRED EMBODIMENT

Figure 1:
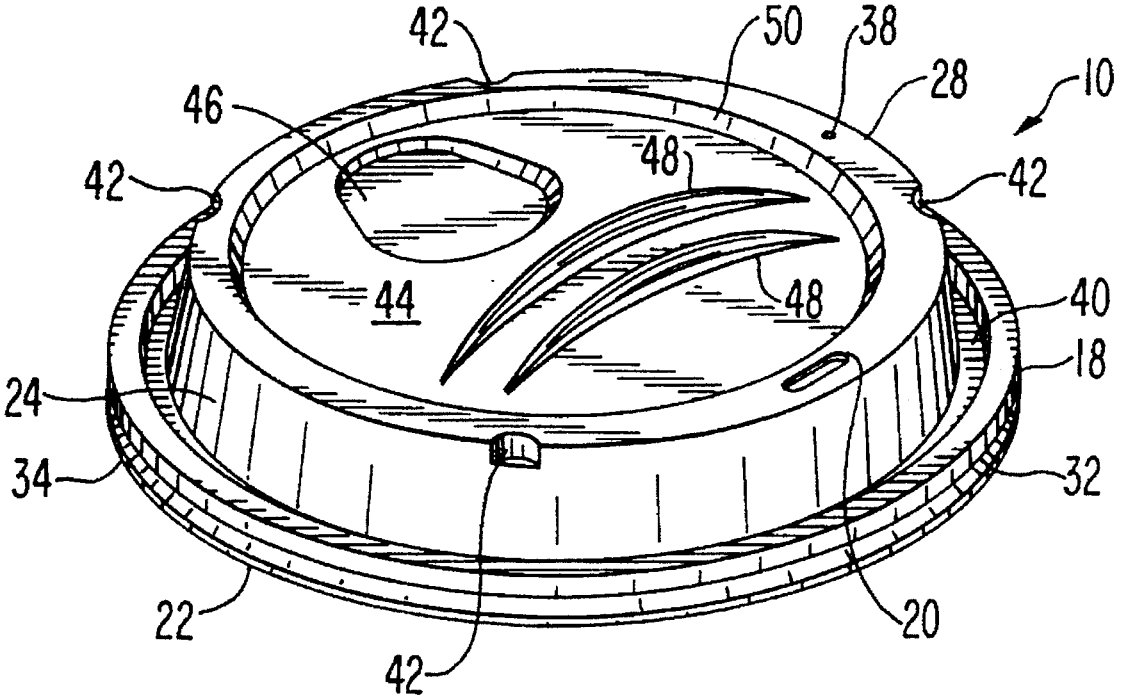
FIG. 1 is a perspective view of a lid in accordance with the present invention.
Figure 2:
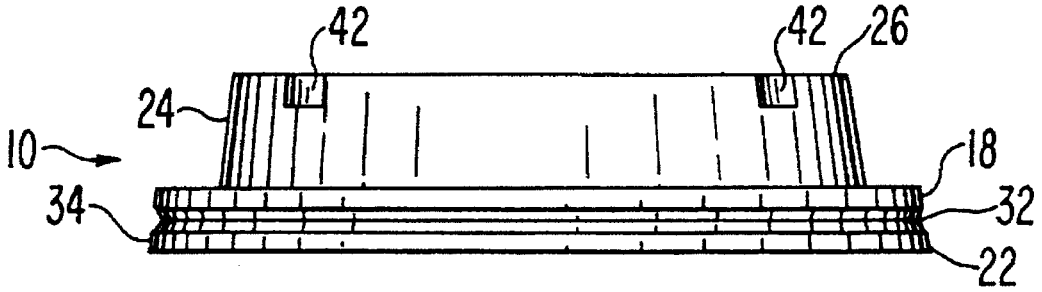
FIG. 2 is an elevational view of the lid of FIG. 1.
Figure 3:
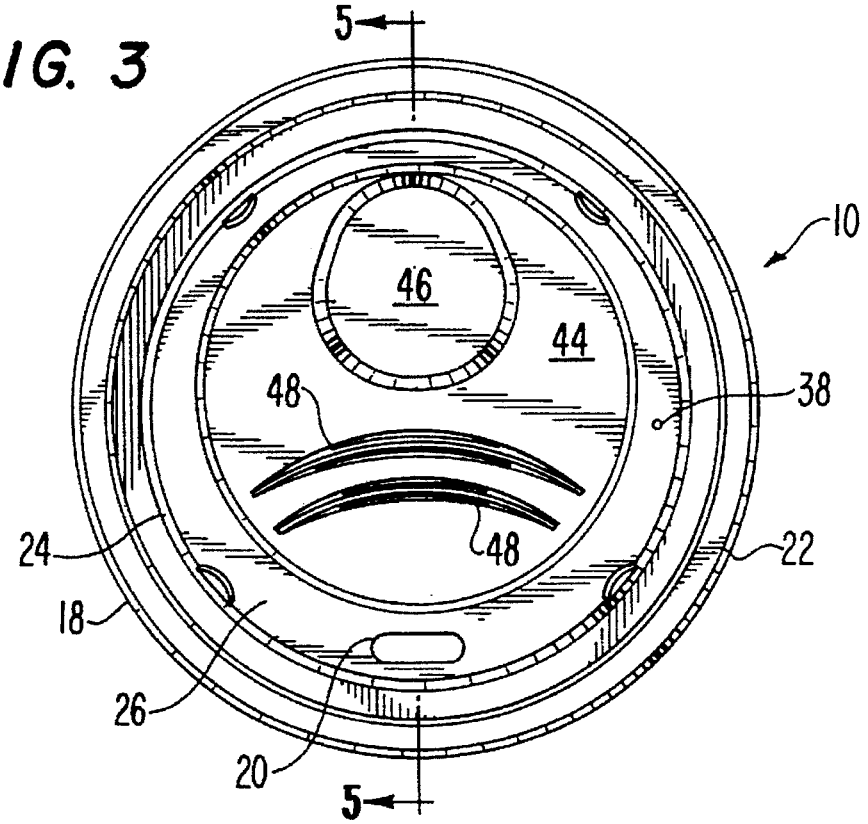
FIG. 3 is a top plan view of the lid illustrated in FIG. 1.
Figure 4:
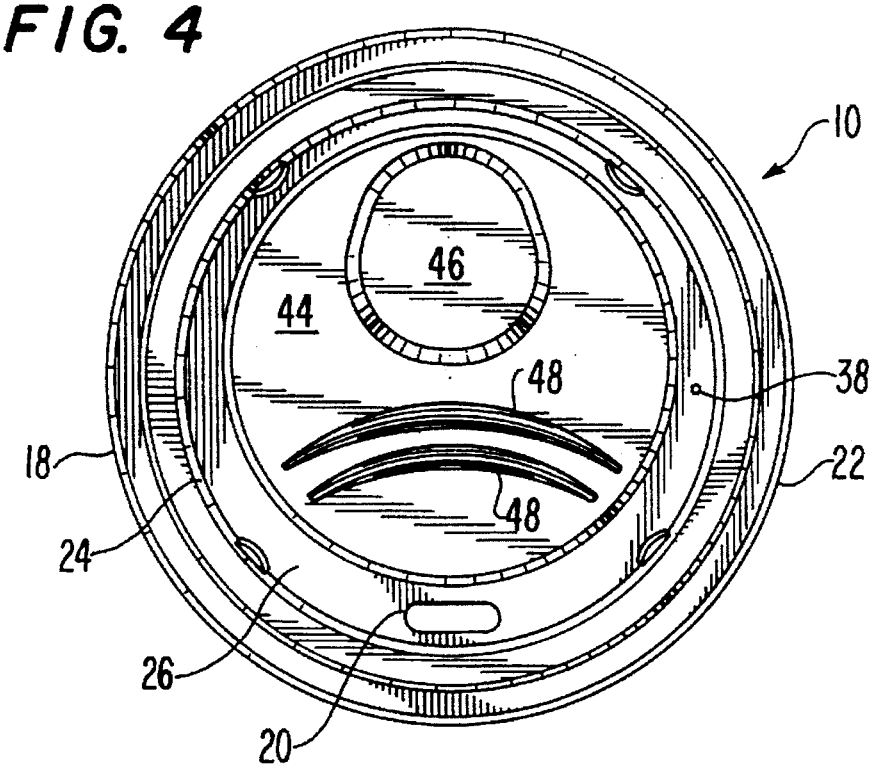
FIG. 4 is a bottom plan view of the lid illustrated in FIG. 1.

The present invention is generally embodied in a lid 10 for a drinking cup 12. For convenience of description, terms such as "upward", "downward", "horizontal", etc., are used herein, referring to the lid in an orientation as illustrated in FIG. 2, however, during use, the lid 10 normally assumes various different orientations.

Figure 6:
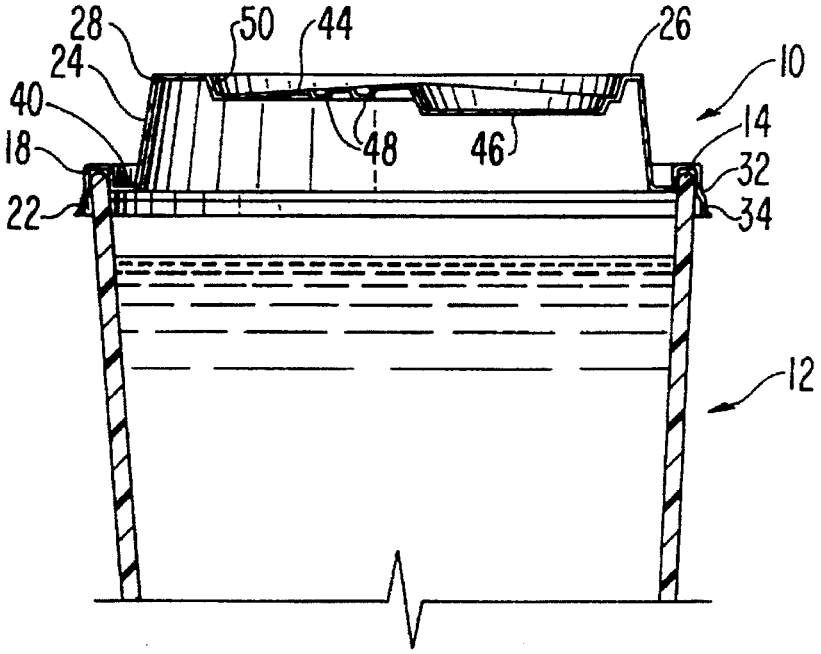
FIG. 6 is a cross-sectional view of the lid in FIG. 1 positioned on a cup.

The lid 10 may be used with cups of various types, and is particularly suitable for use with disposable cups of the type commonly used as carry-out containers for beverages such as coffee and the like. Such cups are commonly made of Styrofoam or paper. As illustrated in FIG. 6, the illustrated cup 12 has a generally circular upper lip or rim 14 with a bead 16 formed on it for receiving and securing the lid thereon.

The lid 10 provides a cover for the cup 12 which inhibits spillage and reduces heat transfer between the beverage and the surrounding atmosphere. The lid 10 is secured in place on the cup 12 by an annular mounting portion 18 which engages the rim or lip 14 of the cup. In the preferred embodiment, a preformed opening 20 is provided to enable drinking from the cup 12 without removal of the lid 10. While the preformed opening 20 is illustrated as being merely an opening in the lid, the opening 20 may include a cover or plug which may be readily removed by the consumer prior to consumption of the contents of the cup.

In accordance with one feature of the present invention, the drinking opening 20 is positioned so that one may drink from the opening 20 without contacting the bottom edge 22 of the lid 20 with his lower lip, which may be uncomfortable. Accordingly, the lid 10 includes an annular side wall 24 extending upwardly from the mounting portion 18 to an annular ridge 26 extending around the top of the lid 10 and having a generally circular periphery 28 adjoining the side wall 24, with the drinking opening 20 being formed in the annular ridge 26.

Referring now to FIGS. 1, 2, 5, and 6, the mounting portion 18 includes a resilient annular gripping portion 32 configured to grip the bead 16 on the lip 14 of the cup 12 and seal there-against as is the case with numerous disposable lids. To facilitate mounting of the lid 10 on the cup 12 and movement of the gripping portion 32 into gripping engagement with the bead 16, the mounting portion 18 further includes an outwardly flared skirt 34 depending from the gripping portion 32. As the lid 10 is pushed downwardly onto the lip 14 of the cup 12, the skirt 34 aids in centering the lid and in deflecting the gripping portion 32 to an open position to enable it to fit over the bead 16. An annular channel 36 is defined at the junction of the gripping portion 32 and the bottom of the side wall 24 which enables liquid to be retained should such liquid drip down the side wall 24. Again, such features being similar to that in the art.

To enable the drinking opening 20 to be spaced from the lower edge 22 of the lid 10 by a distance sufficient to enable one to drink through the opening 20 without contacting the lower edge 22 of the lid 10 with his lower lip 23, the side wall 24 extends upwardly from the mounting portion 18 a distance of about 0.5 inches or more. The spacing of the opening 20 from the mounting portion 22 also serves to inhibit accidental splashing of liquid upward through the opening 20, and enables portions of the lid 10 contacted by the user's mouth to remain relatively cool when a hot beverage is contained in the cup. In the illustrated embodiment, the height of the side wall is slightly over 0.5 inches. This height provides the advantages described above without requiring the material costs associated with production of the lid to be unacceptably high, and without making the lid so bulky as to be unattractive or inconvenient to handle and store. The side wall 24 is preferably frustoconical in shape, sloping upwardly and radially inward from the mounting portion to the annular ridge 26. However, the annular side wall 24 may extend substantially vertically upward from the mounting portion 18. A vent hole 38 is also formed in the annular ridge 26 to enable air flow into the cup 12 as the user drinks from the cup 12 to facilitate the flow of liquid out of the cup 12 through the drinking opening.

As discussed hereinabove, bridging the space between the mounting portion 18 and the upstanding annular wall 24 is the annular channel 36 which readily receives any fluid which may flow out of the opening 20 when the container is jarred or which may built during consumption of the container. As can be seen from FIGS. 1 and 5, the annular channel 36 is significant in size to accommodate more than just a few droplets of fluid. Additionally, an upper portion of the annular wall 24 at the periphery of the annular ridge 26 is provided with a plurality of denesting lugs 42 which prevent lids which are stacked one on top of the other from nesting with one another thus making it difficult to separate the lids. In a conventional manner, the spacing the denesting lugs 42 is random such that no two adjacent lids will have identical spacings therebetween, thus preventing the denesting lugs themselves from nesting with one another.

Figure 5:
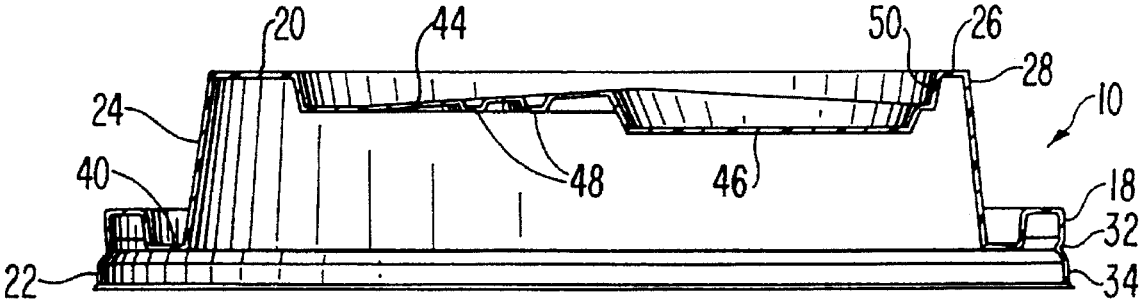
FIG. 5 is a cross-sectional elevational view of the lid of FIG. 1 taken along line 5—5 of FIG. 3.

Additionally, positioned in a plane lower than that of the annular ridge 26 is a periphery of the top surface 44 of the disposable lid which as can be seen from FIGS. 5 and 6 is of a conical configuration having a peak position substantially in the center of the conical surface. Further, the surface 44 is provided with a nose receiving detent 46 which accommodates the user's nose when consuming the contents of a container having the lid positioned thereon. That is, when in the drinking position, in order to lessen the degree of tilt required in the user's neck when consuming the contents of the container, the consumer's nose will extend into the detent 46 formed in the top surface 44. Also formed on the top surface is ridge 48 as illustrated in FIGS. 1, 3, 4 and 6.

As can be readily appreciated from FIGS. 1, 3, 4, 5, and 6, the top surface 44 is not centrally positioned with respect to the outer periphery 28 of the annular ridge 26. That is, in the region of the annular ridge 26 where the drink-thru opening 20 is positioned, the annular ridge is of a widen horizonal dimension. This feature can be readily appreciated from the cross-sectional view illustrated in FIG. 5. This provides for an enlarged surface area for positioning the drink-thru opening 20 which also helps the consumer in consuming the contents of the carton in that it permits the lips of the consumers to readily encompass the drink-thru opening 20. Diametrically opposed from the drink-thru opening 20 is a narrowed region of the annular ridge which provides structural stability to the overall lid construction. In offsetting the top surface 44, a larger surface about the drink-thru opening is permitted while still being able to provide a stacking surface for receiving the bottom of a second container placed atop the lid. In this regard, a retaining wall 50 is formed between the annular ridge 26 and the outer periphery of the top surface 44 which retains a bottom portion of the stacked cup in a predetermined radial position. Accordingly, by forming an asymmetrical annular ridge, the disposable lid configuration can not only accommodate a second container stacked thereon, such lid configuration also readily receives the mouth of the consumer which finds an enlarged surface area for receiving the lips of the consumer. Moreover, an enlarged annular channel may also be provided without limiting the area of the annular ridge where the drink-thru opening is formed.

While the present invention has been described with reference to a preferred embodiment, it should be appreciated by those skilled in the art that the invention may be practiced otherwise than as specifically described herein without departing from the spirit and scope of the invention. It is, therefore, to be understood that the spirit and scope of the invention be limited only by the appended claims.

We claim:

1. A disposable lid for a drinking cup comprising:

an annular mounting portion for sealingly engaging the drinking cup;

an annular side wall extending upwardly from an inner periphery of said annular mounting portion to an asymmetrical annular ridge adjacent said annular side wall, said asymmetrical annular ridge forming a substantially planar surface;

a drinking opening formed in said substantially planar surface; and a crown region having a periphery adjacent said annular ridge having a surface covering a remaining portion of the drinking cup;

wherein said asymmetrical annular ridge includes a widened region for accommodating said drinking opening and a narrowed region diametrically opposed to said widened region.

2. The lid as defined in claim 1, wherein said crown region includes a peak and said surface of said crown region extends upwardly from said periphery to said peak.

3. The lid as defined in claim 2, wherein said periphery of said crown region is substantially circular.

4. The lid as defined in claim 3, wherein said periphery of said crown region lies in a first substantially horizontal plane and said peak lies in a second substantially horizontal plane above said first horizontal plane.

5. The lid as defined in claim 4, wherein said substantially planar surface forming said annular ridge lies in a substantially horizontal plane above said first plane.

6. The lid as defined in claim 5, further comprising a retaining wall extending from said periphery of said crown region to an inner periphery of said annular ridge.

7. The lid as defined in claim 1, further comprising a vent means formed in said annular ridge for venting the drinking cup when contents of the drinking cup are being consumed.

8. A lid for a drinking cup comprising:

an annular mounting portion for sealingly engaging the drinking cup;

an annular side wall extending upwardly from an inner periphery of said annular mounting portion to an annular ridge adjacent said annular side wall, said annular ridge forming a substantially planar surface;

a drinking opening formed in said annular ridge; and a crown region having a periphery adjacent said annular ridge and a peak;

wherein a surface of said crown region extends upwardly from said periphery toward said peak such that said periphery of said crown region lies in a first substantially horizontal plane below said planar surface and said peak lies in a second substantially horizontal plane above said first horizontal plane.

9. The lid as defined in claim 8, wherein said periphery of said crown region is substantially circular.

10. The lid as defined in claim 8, further comprising a retaining wall extending from said periphery of said crown region to an inner periphery of said annular ridge.

11. The lid as defined in claim 10, wherein said annular ridge is asymmetrical having a widened region accommodating said drinking opening and a narrowed region diametrically opposed to said widened region.

12. The lid as defined in claim 8, further comprising a vent means formed in said annular ridge for venting the drinking cup when contents of the drinking cup are being consumed.

13. The lid as defined in claim 8, wherein said annular ridge is asymmetrical having a widened region accommodating said drinking opening and a narrowed region diametrically opposed to said widened region.

14. A disposable lid for a drinking cup comprising:

an annular mounting portion for sealingly engaging both an inner surface and an outer surface of the drinking cup;

an annular trough formed radially inwardly of said annular mounting portion;

an annular side wall extending upwardly from an inner periphery of said annular trough to an annular ridge adjacent said annular side wall;

a drinking opening formed in said annular ridge; and a crown region having a periphery adjacent said annular ridge having a surface covering a remaining portion of the drinking cup;

wherein said crown region includes a peak and said surface of said crown region extends upwardly from said periphery to said peak, such that said periphery of said crown region lies in a first substantially horizontal plane and said peak lies in a second substantially horizontal plane above said first horizontal plane, and said annular ridge includes a substantially planar surface and said surface lies in a substantially horizontal plane above said first plane.

15. The lid as defined in claim 14, further comprising a retaining wall extending from said periphery of said crown region to an inner periphery of said annular ridge.

* * * * *